US008997944B1

(12) United States Patent
Sadeck et al.

(10) Patent No.: US 8,997,944 B1
(45) Date of Patent: Apr. 7, 2015

(54) AUTOMATIC ROPE BRAKE AND LOWERING DEVICE

(71) Applicant: The United States of America as Represented by the Secretary of the Army, Washington, DC (US)

(72) Inventors: James E. Sadeck, East Freetown, MA (US); Dale Tabor, Warren, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 106 days.

(21) Appl. No.: 13/671,582

(22) Filed: Nov. 8, 2012

(51) Int. Cl.
*B65H 59/16* (2006.01)
*B65H 59/20* (2006.01)
*B66D 5/16* (2006.01)

(52) U.S. Cl.
CPC . *B66D 5/16* (2013.01); *B65H 59/20* (2013.01)

(58) Field of Classification Search
USPC ..... 188/65.1–65.5, 188; 182/5, 192; 294/86.42
See application file for complete search history.

(56) References Cited

U.S. PATENT DOCUMENTS

| | | | | | |
|---|---|---|---|---|---|
| 2,434,358 | A * | 1/1948 | Frank | 439/788 |
| 3,343,231 | A * | 9/1967 | Clay | 24/136 R |
| 3,830,346 | A * | 8/1974 | Watts | 188/188 |
| 3,840,212 | A * | 10/1974 | Latanision | 248/329 |
| 4,055,875 | A * | 11/1977 | Strickland | 24/115 R |
| 4,068,608 | A * | 1/1978 | Hartz | 114/199 |
| 4,254,941 | A * | 3/1981 | Tanson | 254/267 |
| 4,482,103 | A * | 11/1984 | Sano et al. | 242/381.4 |
| 5,265,696 | A * | 11/1993 | Casebolt | 182/8 |
| 7,416,158 | B2 * | 8/2008 | Sadeck | 244/149 |

* cited by examiner

*Primary Examiner* — Xuan Lan Nguyen
(74) *Attorney, Agent, or Firm* — Roger C. Phillips

(57) ABSTRACT

Linear brake systems are provided. For example, in one embodiment, a baseplate having a linear brake housing mounted thereto is provided. A linear brake is partially disposed within the brake housing. The linear brake includes a braided cable; a collar attached to the proximal end of the braided cable; a member attached to the distal end of the braided cable; a rope having a portion that passes into a bore in the collar, through a tunnel formed by the braided cable and the collar, and exits the braided cable by passing between cable strands; and an interface mounted to the baseplate to extend the braided cable constrict the braided cable upon the rope. The collar secures the proximal of the braided cable to the brake housing and the member secures the distal end of the braided cable to the interface.

8 Claims, 4 Drawing Sheets

Fig. 1
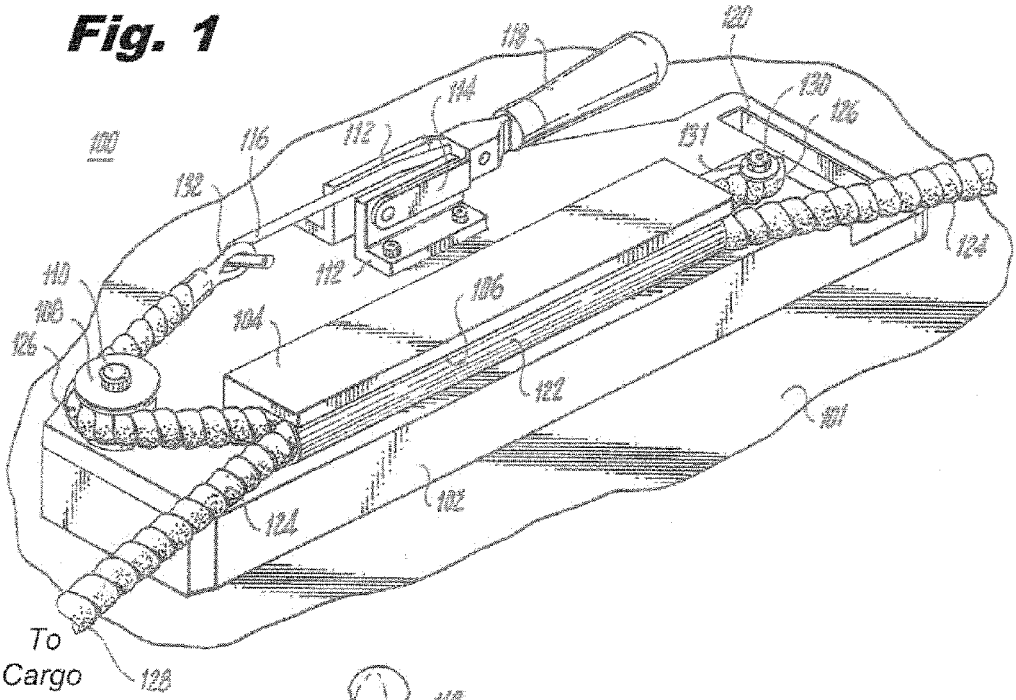
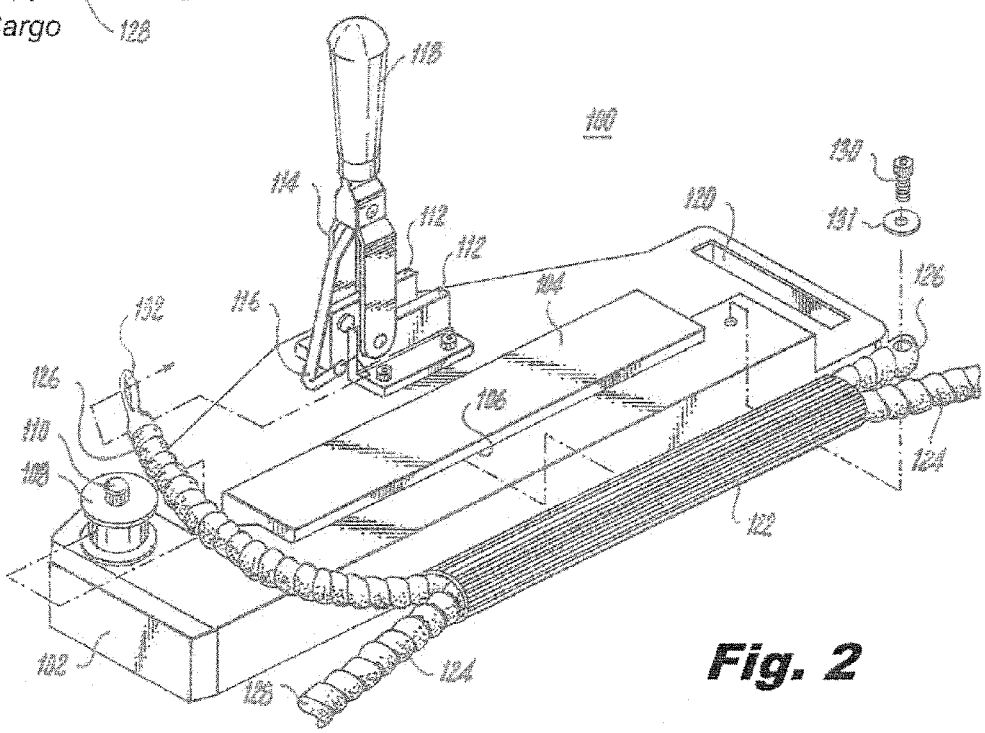
Fig. 2

Fig. 3
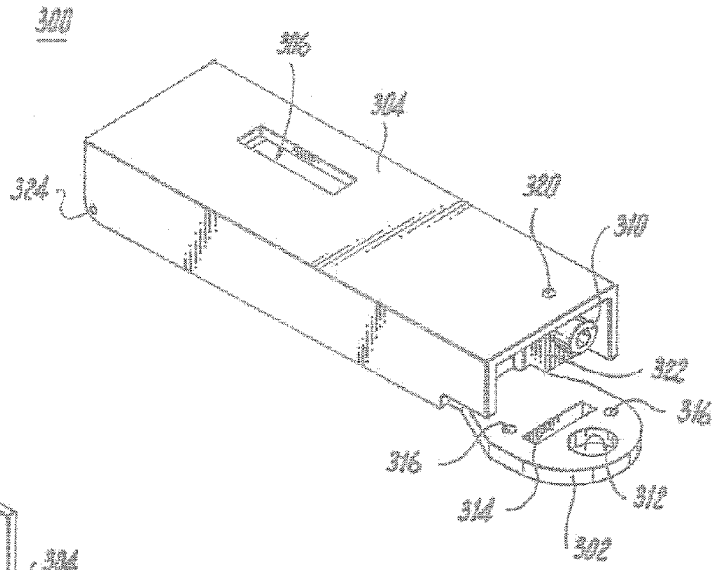
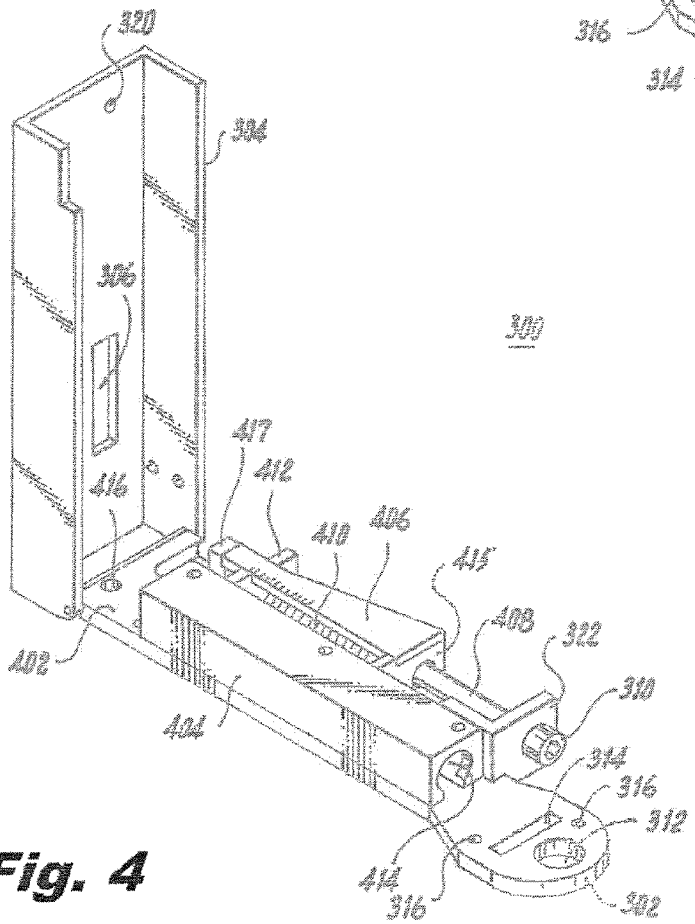
Fig. 4

AUTOMATIC ROPE BRAKE AND LOWERING DEVICE

BACKGROUND

1. Field of the Invention

Embodiments herein generally relate to apparatuses for providing more control over dissemination of supplies. In particular, the present invention relates to novel apparatuses for linear braking systems.

2. Description of the Related Art

There are instances when items (e.g., supplies) need to be lowered from an aerial vehicle to the ground. For example, the United States military (e.g., the United States Army) often lowers supplies from a rotary ringed aircraft (e.g., a helicopter) to ground troops. In some instances there is a need to deliver mission essential supplies to ground troops engaged in enemy combat. Rotary wing aircraft are typically the transport platform for these supplies. Many times the aircraft cannot land and supplies are free dropped from as high as 150 feet above the ground. Losses of badly needed supplies such as medicine, ammunition, water, and food, are high, due to the free drop.

Thus there is a need in the art for a device that helps to reduce the losses of supplies that are lowered (e.g., from an aircraft) to the ground.

SUMMARY

Embodiments herein generally relate to apparatuses for providing more control over dissemination of supplies. In particular, the present invention relates to novel apparatuses for linear braking systems.

For example, in one embodiment, a baseplate is provided. Secured to the baseplate is a linear brake housing for a linear brake. The linear brake includes a linear brake sleeve, a cable attached to an interior of the linear brake sleeve, and a rope in the interior of the linear brake sleeve. A toggle clamp is also mounted to the baseplate to adjust tension on the linear brake (i.e., by adjusting tension of the cable). The toggle clamp includes a toggle clamp bracket secured to the baseplate, a toggle clamp lever pivotally connected to the toggle clamp bracket, and a toggle clamp hook connected to the toggle clamp lever. As tension on the cable increases, the linear brake sleeve is stretched and the cross-sectional area of the linear brake sleeve decreases. Because the cross-sectional area of the linear brake sleeve has decreased the linear brake sleeve provides a constricting force on the rope that makes passage of the rope through the linear brake sleeve more difficult thereby slowing movement of a load attached to the rope.

In another embodiment of the invention, the brake system includes a baseplate, a linear brake housing adapted to receive a linear brake, and a spring carriage secured to the baseplate. Also included is a fixed carriage plate having a bore and a compression bolt tension angle having a bore aligned with the bore of the fixed carriage plate. A moveable spring compression plate is disposed between the spring carriage and the baseplate. A compression spring is disposed within a cavity formed by the fixed carriage plate, the moveable spring compression plate, and the spring carriage. A compression bolt is inserted in the aligned bores of the compression bolt tension angle and the fixed carriage plate and through the compression spring. When the compression bolt is rotated in a direction which causes the moveable spring compression plate to move towards the fixed carriage plate more tension is applied to a linear brake braided cable attached to the moveable spring compression plate. The increased tension constricts the rope contained within the brake sleeve thereby slowing movement of a load attached to the rope.

In yet another embodiment of the invention, a baseplate having a linear brake housing mounted thereto is provided. A linear brake is partially disposed within the brake housing. The linear brake includes a braided cable; a collar attached to the proximal end of the braided cable; a member attached to the distal end of the braided cable; and a rope having a portion that passes into a bore in the collar, through a tunnel formed by the braided cable and the collar, and exits the braided cable by passing between cable strands. An interface mounted to the baseplate is used to extend the braided cable and constrict the braided cable upon the rope. The collar secures the proximal of the braided cable to the brake housing and the member secures the distal end of the braided cable to the interface.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 depicts a perspective view of an embodiment of a device in accordance with aspects of the invention;

FIG. 2 depicts an exploded view of the embodiment of the device depicted in FIG. 1;

FIG. 3 depicts a perspective view of another embodiment of a device in accordance with aspects of the invention;

FIGS. 4-8 depict different perspective views of the embodiment of the device depicted in FIG. 3.

To facilitate understanding, identical reference numerals have been used, wherever possible, to designate identical elements that are common to the figures.

DETAILED DESCRIPTION

Figure 5:
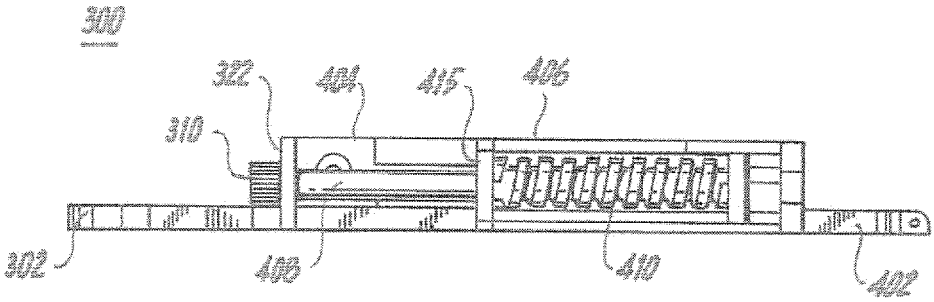

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

FIG. 1 depicts a perspective view of an embodiment of a rope brake 100 in accordance with aspects of the invention. The linear rope brake 100 includes a brake frame 102. Mounted on the brake frame 102 are a linear brake housing 104, a spool 108, and a toggle clamp bracket 112. The rope brake 100 is depicted as being mounted on a surface 101 (e.g., a helicopter floor).

The brake frame 102 includes a brake base slot 120. The dimensions (i.e., length, width, and height) of the brake frame 102 are sufficient in size for structural integrity of the brake system 100 and for room to secure the linear brake housing 104 and the spool 108 to the brake frame 102. Brake frame 102 is the foundation for the linear brake 100.

A toggle clamp 114 is attached to the toggle clamp bracket 112. The toggle clamp bracket secures the toggle clamp 114 to the brake frame 102 and allows the toggle clamp 114 to pivot when needed. Also attached to the toggle clamp 114 are a handle 118 and a toggle clamp hook 116.

The linear brake housing 104 includes a brake channel 106. The brake channel 106 is parallel to a longitudinal axis of the linear brake housing 104 and extends through the entire length of the brake channel 106. The brake channel 106 is of sufficient size and shape to allow a linear brake (i.e., a linear brake sleeve 122, a rope 124, and a braided cable 126) to be placed therein. For example, in various embodiments of the invention, the brake channel 106 is in the shape of an annular groove that has sufficient size for the linear brake sleeve 122, rope 124, and braided cable 126 to reside therein. In various embodiments of the invention, the brake channel 106 is also contoured to minimize damage to the braided cable 126 due to rubbing of the braided cable 126 on edges of the linear brake housing 104.

Braided cable 126 has two ends. One of the ends of the braided cable 126 is receptive to a pin/screw 130 and washer 131 that anchor the braided cable 126 to the brake frame 102. The other end of the braided cable 126 is formed into a braided cable loop 132. The braided cable loop 132 fits onto a toggle clamp hook 116.

An anchor pin 108 is used to mount a spool 110 to the brake frame 102. The spool 110 is positioned, on the brake frame 102, between the toggle clamp hook 116 and the linear brake housing 104.

A portion of the braided cable 126 is secured to the interior of the linear brake sleeve 122. The braided cable 126 and linear brake sleeve 122 deform (i.e. stretch or extend) when a tensional force is applied to the braided cable 126. As more tensional force is applied to the linear brake sleeve 122, the linear brake sleeve 122 and the attached braided cable 126 are extended and the cross-sectional area of the linear brake sleeve 122 is reduced.

Reducing the cross-sectional area (i.e., constricting the cross-sectional area) of the linear brake sleeve 122 provides a frictional breaking force upon the rope 124 that passes through the hollow center of linear brake sleeve 122.

FIG. 1 depicts the toggle clamp 114 in a fully engaged position that provides the most tension (hereinafter referred to as "closed position") to the braided cable 126. In contrast, the toggle clamp 114 can be pivoted to a position (i.e., rotated away from the closed position and towards toggle clamp hook 116) (not shown) that provides less tension than the tension provided in the closed position (or no tension when fully disengaged) to the braided cable 126.

When toggle clamp 118 is fully engaged (i.e., in the closed position), a tensile force is induced upon linear brake housing 104. This tensile force translates into a radial clamping force around rope 124 providing a braking action on rope 124. When the length of toggle clamp hook 116 is adjusted correctly, using toggle clamp 114, rope 124 can be made to pass through linear brake housing 104 to allow a payload (not shown) attached to rope 124 (at rope end 128) to descend at a constant rate of speed.

Brake frame 102 includes a slot 120 to secure brake frame 120 to an anchoring structure (e.g. an aircraft, building, vehicle, or other platform).

FIG. 2 depicts an exploded view of the embodiment of the linear rope brake 100 depicted in FIG. 1. Specifically, FIG. 2 depicts the linear brake sleeve 122, rope 124, and braided cable 126 outside of the brake longitudinal groove 106 and detached from the brake system 100. For illustrative purposes, the braided cable 126 is not in contact with the spool 108; the toggle clamp hook 116 is not hooked onto the braided cable end loop 132; and the braided cable end screw 130 does not secure an end of the braided cable 126 to the brake base 102.

FIG. 3 depicts a perspective view of another embodiment of a device 300 in accordance with aspects of the invention. Specifically, the device 300 depicted in FIG. 3 is a different embodiment of a rope brake system (hereinafter referred to as "rope brake system 300"). In FIG. 3, the rope brake system 300 is depicted as having a brake frame cover 304 secured to a brake frame plate (note that in FIG. 3, only a mounting plate head 302 of the brake frame plate is visible). In FIG. 3, the rope brake system 300 is depicted in a "covered position" (i.e., interior components of the rope brake system 300 are "sandwiched" between the brake frame cover 304 and the brake frame plate.

The brake frame cover 304 includes a view port slot 306 for viewing a tension setting of the rope brake system 300, and a hole 320 for a cover screw (not shown) to secure the brake frame cover 304 to the brake frame plate in the closed position.

In various embodiments of the invention, one end of the brake frame cover 304 is adapted to pivot about one end of the brake frame plate. For example, FIG. 3 illustratively depicts elements 324 that are adapted to interact with the brake frame mounting plate to create a pivot point to allow brake frame cover 304 to rotate (i.e., to position the brake frame cover 304 in an "open position," a "closed position," or points therebetween) with respect to the brake frame mounting plate. Elements 324 can have various shapes to enable rotation (e.g., elements 324 can be holes or dimples to receive protrusions on the brake frame mounting plate or elements 324 can be protrusions that extend into holes or dimples in the brake frame mounting plate).

That portion of the brake frame plate that is visible in FIG. 3 (i.e., the mounting plate head 302) includes a carabiner hole 312 for receiving a carabiner, a webbing attachment slot 314, and screw holes 316 for mounting the rope brake system to a secondary surface (e.g., the floor of a helicopter).

Substantially perpendicular to mounting plate head 302 is a bracket 322 that serves as a tension angle for a compression bolt. Visible (in FIG. 3) on the outside of the bracket 322 is a compression bolt head 310.

FIG. 4 depicts a perspective view of the embodiment of the rope brake system 300 depicted in FIG. 3. FIG. 4 depicts the rope brake system 300 with the brake frame cover 304 rotated to expose the interior of the rope brake system 300. The brake frame plate 402 and mounting plate head 302 are both visible in FIG. 4. Mounted on the brake frame plate 402 are a linear brake housing 404, a spring carriage 406, a fixed carriage plate 415, and the compression bolt tension angle 322.

The fixed carriage plate 415 is attached to one end of the spring carriage 406. A moveable spring compression plate 412 is within a cavity formed by the spring carriage 406.

The longitudinal axis of the linear brake housing 404 is substantially parallel to the longitudinal axis of the spring carriage 406. The compression bolt tension angle 322, moveable spring compression plate 412, and fixed carriage plate 415 are substantially parallel to one another and substantially perpendicular to the longitudinal axis of the spring carriage 406 (and linear brake housing 404).

The linear brake housing 404 includes brake portals 414 (only one is visible in FIG. 4) for a rope to pass through.

A compression spring 410 is positioned between the movable spring compression plate 412 and the fixed carriage plate 415. A compression bolt/shaft is inserted through the central axis of the compression spring 410.

Under Hooke's Law a spring rate associated with the compression spring 410 can be determined. For example, every tenth of inch of compression of the compression spring 410 a determination can be made of the axial forces on a rope brake (e.g., rope brake 800 describe below and depicted in FIG. 8). With knowledge of the spring rate, marks can be placed on the system indicative of an acceptable rate of descent for a given load.

The compression bolt/shaft 408 is threaded so that as the compression bolt/shaft 408 is turned (via the bolt head 310), the moveable spring compression plate 412 moves either towards the bolt head 310 or away from the bolt head 310 depending on the direction in which the bolt head 310 is rotated. Movement of the moveable spring compression plate 412 applies tension on (or reduces tension upon) an attached linear brake. For example, when the bolt head 310 is rotated in a direction, which causes the moveable spring compression plate 412 to move towards bolt head 310, more tension is applied to a linear brake braided cable attached to the moveable carriage end 417. The increased tension constricts the rope contained within the brake sleeve.

The spring carriage 406 includes hash marks indicative of the amount of force (due to tension) asserted on the rope. In various embodiments of the invention, pairs of hash marks indicate an acceptable braking force to apply to a given load. For example, when a 200 lb. load is attached to the system 300, the system 300 can be adjusted so that the moveable spring compression plate 412 is between a pair of hash marks for safely lowering the 200 lb load (and not damage the load). When a load lighter than 200 lbs. is lowered using the same setting (i.e., the moveable spring compression plate 412 is between the pair of hash marks for lowering the 200 lb. load) the light load will descend at a lower rate (than the 200 lb. load).

Although embodiments of the invention are described herein as using a compression spring 410 other embodiments of the invention do not require the compression spring 410. For example, other embodiments of system 300 do not include the compression spring 410.

FIGS. 5-8 depict different perspective views of the embodiment of the device 300 depicted in FIG. 4. In FIGS. 5 through 8, the brake frame cover 304 is not present (for illustrative purposes only).

FIG. 5 depicts a side perspective view of the device 300. In FIG. 5, the compression bolt/shaft 408, fixed carriage plate 415, and compression spring 410 are viewable.

Figure 6:
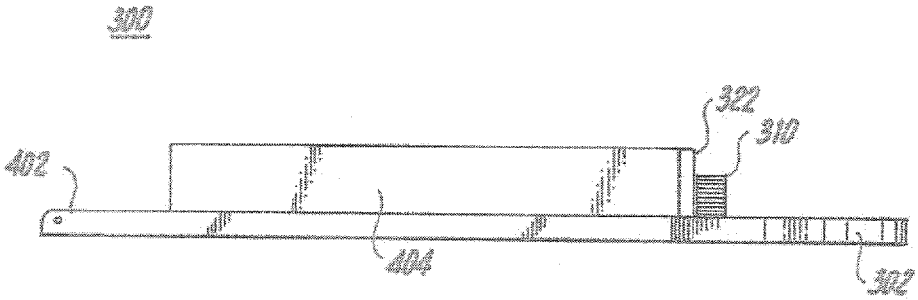

FIG. 6 depicts a different perspective view of the device 300. FIG. 6 depicts a side perspective view opposite to the side perspective view depicted in FIG. 5. In FIG. 6, the linear brake housing 404 and compression bolt head 310 are viewable.

Figure 7:
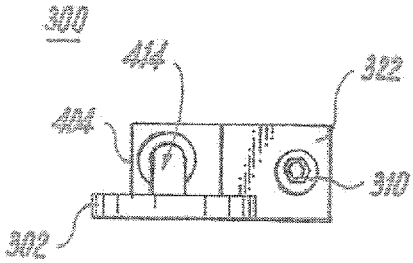

FIG. 7 depicts a direct perspective view of the compression bolt head 310 and brake portal 414 of the device 300.

Figure 8:
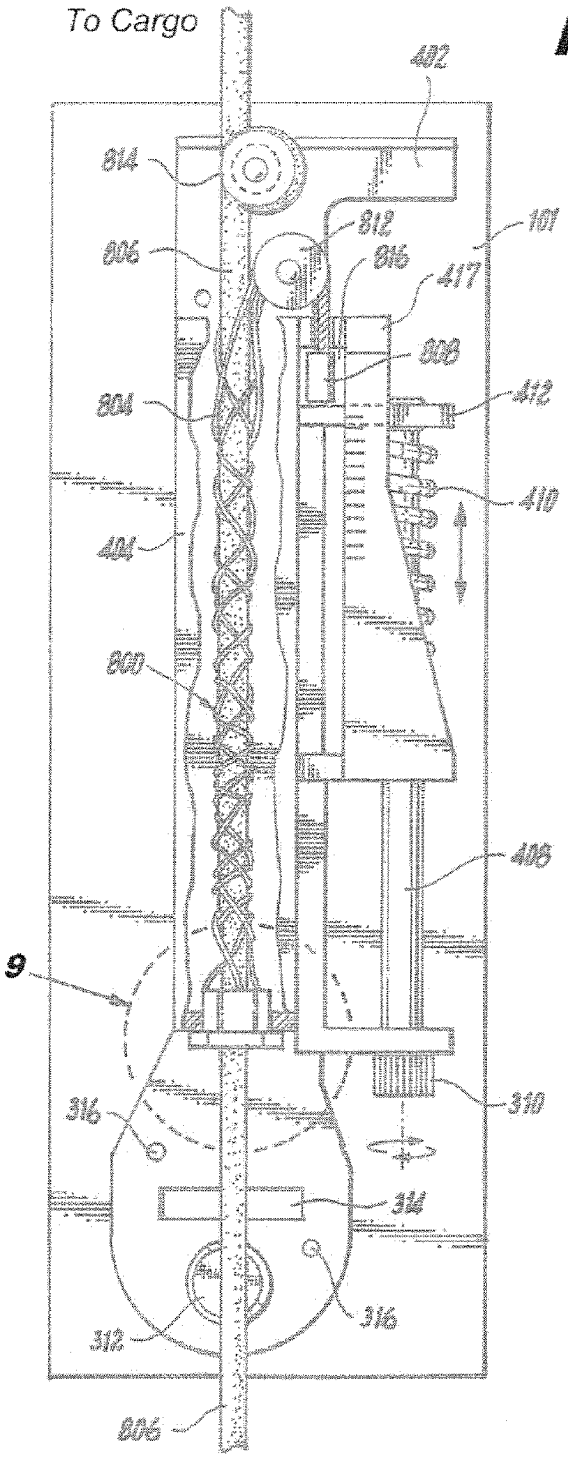
Figure 9:
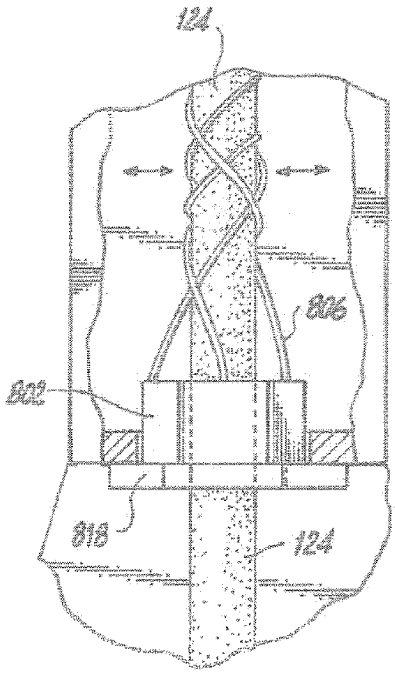
FIG. 9 depicts a close-up perspective view of the embodiment of the device depicted in FIG. 8.

FIG. 8 depicts a perspective view of the embodiment of the invention depicted in FIGS. 4-7. However, FIG. 8 also includes an embodiment of a rope brake 800 that can be used in conjunction with the embodiment depicted in FIGS. 1-3 (with slight modifications explained below).

For illustrative purposes, a portion of the linear brake housing 404 is transparent so that the linear rope brake 800, partially disposed within, is visible.

The linear rope brake 800 includes a braided cable 804. Attached to one end of the braided cable 804 is a collar 802 and attached to the other end of the braided cable 804 is a member 808 (hereinafter illustratively described as having a cylinder shape and is referred to as "cylinder 808").

The collar 802 is configured for insertion into brake portal 414. The collar 802 includes a lip 818 around its periphery that is larger than the brake portal 414 and prevents the collar 802 from moving, through the brake portal 414, past the lip 818. The collar 802 has a bore that allows insertion of a rope 806 into a tunnel formed by the braided cable 804. The inserted end of the rope 806 exits the braided cable 804 by passing between braids of the braided cable 804. The inserted end of the rope 806 may then be connected to a load (e.g., cargo).

FIG. 8 also includes an optional spool 814. The optional spool 814 is secured to the brake frame mounting plate 402 and is configured (e.g., has a larger diameter at its upper most edge) so that the rope 806 does not slip off of the optional spool 814. The rope 806 is wrapped (at least one time) around the optional spool 814 to increase the load capacity of the brake system 300. For example, if the brake system 300 has a capacity of 400 lbs. then the addition of optional spool 814 would increase the load capacity of the system 300 beyond 400 lbs.

In various embodiments of the invention, the system 300 includes multiple optional spools 814. With the addition of each optional spool 814 the load capacity of the system 300 is increased. To accommodate additional optional spools 814 the size of the brake frame mounting plate 402 is increased.

The end of the braided cable 804 having the cylinder 808 passes over a rotatable bushing/spool 812 and is inserted into a slot/cradle 816. The rotatable bushing/spool 812 prevents drag on the braided cable 804 due to friction. The slot/cradle 816 is sufficient in size for the cylinder 808 to reside therein.

The brake portal 414 and collar 802 combination and cylinder 808 and slot/cradle 816 combination help secure the linear brake sleeve 800 to the system 300.

Note that although member 808 has been depicted and described as having a cylinder shape it is not intended in any way to limit the scope of the invention. For example, in various embodiments of the invention, member 808 has other shapes (e.g., a ball shape or loop shape) that secure the member 808 to the interface used to adjust the brake (e.g., to prevent an end of the braided cable 804 from moving out of the slot/cradle 816).

To adjust the braking force applied by the brake system 300, the compression bolt/shaft 408 is rotated (i.e., by rotating the compression bolt head 310). In accordance with this rotation, carriage end 417; slot/cradle 816; and moveable spring compression plate 412 move either towards bolt head 310 or away from bolt head 310 (depending or the direction of rotation of the compression bolt/shaft 408). When the cylinder 808 is in the slot/cradle 816 and the rotation of the bolt/shaft 408 causes the moveable spring compression plate 412 to move towards the compression bolt head 310 the braided cable 804 is extended and more tension is applied to the braided cable 804. As the tension on the braided cable 804 is increased, the cross-sectional area of the braided cable 804 is reduced. Reducing the cross-sectional area (i.e., constricting the cross-sectional area) of the braided cable 804 provides a frictional breaking force upon the rope 806 as it passes through the tunnel formed by the braided cable 804.

For illustrative purposes only, the rope brake 800 is depicted with embodiment 300 of the invention. However, that depiction is not intended in any way to limit the scope of the invention. For example, the rope brake 800 can be used with embodiment 100 depicted in FIGS. 1 and 2 (with replacing/modifying cylinder 808, collar 802, and/or linear brake housing 104).

Although aspects of the invention have been described herein as devices for lowering a load, these descriptions are not intended in any way to limit the scope of

We claim:

1. A brake system comprising:

a baseplate, wherein said baseplate includes a longitudinal axis, a proximal end, and a distal end;

a linear brake housing secured to said baseplate;

a linear brake partially disposed within said brake housing; and an interface mounted to said baseplate to extend a portion of said linear brake and adjust tension applied by said linear brake; and wherein said linear brake comprises:

a braided cable, wherein said braided cable has a proximal end and a distal end;

a collar attached to said proximal end of said braided cable, wherein said collar has a bore there-through and a peripheral lip;

a member attached to said distal end of said braided cable; and a rope, wherein a portion of said rope passes into said bore, through a tunnel formed by said braided cable and said collar, and exits said braided cable by passing between cable strands;

wherein said interface comprises:

a spring carriage wherein said spring carriage includes a distal end and a proximal end, said proximal end of said spring carriage is secured to said baseplate;

a fixed carriage plate having a bore and substantially perpendicular to said spring carriage, said fixed carriage plate secures said distal end of said spring carriage to said baseplate;

a moveable spring compression plate disposed between said spring carriage and said baseplate, said moveable spring compression plate is substantially parallel to said fixed carriage plate and is moveable between said proximal end of said carriage plate and said fixed carriage plate, said moveable spring compression plate includes a portion adapted to receive said male member;

a compression bolt tension angle having a bore and secured to said baseplate, said compression bolt tension angle is substantially perpendicular to said baseplate and substantially parallel to said fixed carriage plate;

a compression spring disposed within a cavity formed by said fixed carriage plate, said moveable spring compression plate, and said spring carriage; and a compression bolt inserted in said bore of said compression bolt tension angle, said bore of said fixed carriage plate, and said compression spring.

2. A brake system comprising:

a baseplate, wherein said baseplate includes a longitudinal axis, a proximal end, and a distal end;

a linear brake housing secured to said baseplate;

a linear brake partially disposed within said brake housing; and an interface mounted to said baseplate to extend a portion of said linear brake and adjust tension applied by said linear brake; and wherein said linear brake comprises:

a braided cable, wherein said braided cable has a proximal end and a distal end;

a collar attached to said proximal end of said braided cable, wherein said collar has a bore there-through and a peripheral lip;

a member attached to said distal end of said braided cable; and a rope, wherein a portion of said rope passes into said bore, through a tunnel formed by said braided cable and said collar, and exits said braided cable by passing between cable strands; and further comprising a rotatable cable spool mounted on said baseplate, wherein said rotatable cable spool is contoured to guide a portion of said cable.

3. The brake system of claim 2 further comprising at least one rope spool, wherein said at least one rope spool is contoured to guide said rope.

4. The brake system of claim 2 wherein said member is one of a cylinder, a ball, and a loop.

5. The brake system of claim 2 wherein said interface comprises:

a spring carriage wherein said spring carriage includes a distal end and a proximal end, said proximal end of said spring carriage is secured to said baseplate; a fixed carriage plate having a bore and substantially perpendicular to said spring carriage, said fixed carriage plate secures said distal end of said spring carriage to said baseplate;

a moveable spring compression plate disposed between said spring carriage and said baseplate, said moveable spring compression plate is substantially parallel to said fixed carriage plate and is moveable between said proximal end of said carriage plate and said fixed carriage plate;

a compression bolt tension angle having a bore and secured to said baseplate, said compression bolt tension angle is substantially perpendicular to said baseplate and substantially parallel to said fixed carriage plate;

a compression spring disposed within a cavity formed by said fixed carriage plate, said moveable spring compression plate, and said spring carriage; and a compression bolt inserted in said bore of said compression bolt tension angle, said bore of said fixed carriage plate, and said compression spring.

6. A brake system comprising:

a baseplate, wherein said baseplate includes a longitudinal axis, a proximal end, and a distal end;

a linear brake housing secured to said baseplate;

a linear brake partially disposed within said brake housing, wherein said linear brake comprises:

a braided cable, wherein said braided cable has a proximal end and a distal end;

a collar attached to said proximal end of said braided cable, wherein said collar has a bore there-through and a peripheral lip;

a member attached to said distal end of said braided cable; and a rope, wherein a portion of said rope passes into said bore, through a tunnel formed by said braided cable and said collar, and exits said braided cable by passing between cable strands; and an interface mounted to said baseplate to extend said braided cable and constrict said braided cable upon said rope; and wherein said interface comprises:

a spring carriage wherein said spring carriage includes a distal end and a proximal end, said proximal end of said spring carriage is secured to said baseplate; a fixed carriage plate having a bore and substantially perpendicular to said spring carriage, said fixed carriage plate secures said distal end of said spring carriage to said baseplate;

a moveable spring compression plate disposed between said spring carriage and said baseplate, said moveable spring compression plate is substantially parallel to said fixed carriage plate and is moveable between said proximal end of said carriage plate and said fixed carriage plate, said moveable spring compression plate includes a portion adapted to receive said male member;

a compression bolt tension angle having a bore and secured to said baseplate, said compression bolt tension angle is substantially perpendicular to said baseplate and substantially parallel to said fixed carriage plate;

a compression spring disposed within a cavity formed by said fixed carriage plate, said moveable spring compression plate, and said spring carriage; and a compression bolt inserted in said bore of said compression bolt tension angle, said bore of said fixed carriage plate, and said compression spring.

7. A brake system comprising:

a baseplate, wherein said baseplate includes a longitudinal axis, a proximal end, and a distal end;

a linear brake housing secured to said baseplate;

a linear brake partially disposed within said brake housing, wherein said linear brake comprises:

a braided cable, wherein said braided cable has a proximal end and a distal end;

a collar attached to said proximal end of said braided cable, wherein said collar has a bore there-through and a peripheral lip;

a member attached to said distal end of said braided cable; and a rope, wherein a portion of said rope passes into said bore, through a tunnel formed by said braided cable and said collar, and exits said braided cable by passing between cable strands; and an interface mounted to said baseplate to extend said braided cable and constrict said braided cable upon said rope;

further comprising a rotatable cable spool mounted on said baseplate, wherein said rotatable cable spool contoured to guide a portion of said cable.

8. The brake system of claim 7 further comprising at least one rope spool mounted to said baseplate and contoured to guide said rope.

* * * * *